US011013299B2

(12) United States Patent
Hung et al.

(10) Patent No.: US 11,013,299 B2
(45) Date of Patent: May 25, 2021

(54) SLIDER FOR SLIDE FASTENER

(71) Applicant: IDEAL FASTENER (GUANGDONG) INDUSTRIES LTD., Guangdong (CN)

(72) Inventors: Franklin Chi Yen Hung, Guangdong (CN); Guoliang Qiu, Guangdong (CN); Wei Qiu, Guangdong (CN); Zongjian Lyu, Guangdong (CN); Fukang Wu, Guangdong (CN)

(73) Assignee: IDEAL FASTENER (GUANGDONG) INDUSTRIES LTD., Zhaoqing (CN)

( * ) Notice: Subject to any disclaimer, the term of this patent is extended or adjusted under 35 U.S.C. 154(b) by 0 days.

(21) Appl. No.: 16/574,135

(22) Filed: Sep. 18, 2019

(65) Prior Publication Data

US 2020/0008541 A1 Jan. 9, 2020

Related U.S. Application Data

(60) Division of application No. 15/823,541, filed on Nov. 27, 2017, now Pat. No. 10,624,428, which is a continuation of application No. PCT/CN2016/105789, filed on Nov. 14, 2016.

(51) Int. Cl.
*A44B 19/30* (2006.01)
*A44B 19/26* (2006.01)

(52) U.S. Cl.
CPC ..... *A44B 19/262* (2013.01); *A44B 19/26* (2013.01); *A44B 19/305* (2013.01); *A44B 19/306* (2013.01); *Y10T 24/2568* (2015.01)

(58) Field of Classification Search
CPC ..... A44B 19/26; A44B 19/262; A44B 19/30; A44B 19/305; A44B 19/306; A44B 19/308; Y10T 24/2568
See application file for complete search history.

(56) References Cited

U.S. PATENT DOCUMENTS 2,228,146 A * 1/1941 Morin ..... A44B 19/305 24/419
2,290,834 A * 7/1942 Kohler ..... A44B 19/305 24/419
2,303,751 A * 12/1942 Marinsky ..... A44B 19/308 24/424
2,397,693 A * 4/1946 Rabinow ..... A44B 19/308 24/420
2,535,505 A * 12/1950 Morin ..... A44B 19/305 24/419

(Continued)

*Primary Examiner* — Robert Sandy
*Assistant Examiner* — Michael S Lee

(57) ABSTRACT

A slider, includes a slider base, a pull-tab, a connecting shaft and a spring; the slider base includes an upper blade, a lower blade, and a connecting pin connecting the upper blade and the lower blade; said pull-tab is integrated with the connecting shaft; the pull-tab includes a pull-tab body, with a spring mounting part and a locking part set at the anterior-end-face of the pull-tab body; the anterior-end-face of the pull-tab body is set as a locking vertical plane and the bottom of the pull-tab body is set as cambered surface; the connecting shaft is fixed to the anterior-end of the pull-tab body and the length of the connecting shaft is larger than the width of the anterior-end-face of the pull-tab body; the connecting shaft runs through the spring mounting part and the locking part and extends to both sides of the anterior-end of the pull-tab body.

13 Claims, 13 Drawing Sheets

(56) References Cited

U.S. PATENT DOCUMENTS

| | | | | | |
|---|---|---|---|---|---|
| 2,784,474 | A | * | 3/1957 | Morin | A44B 19/308<br>24/424 |
| D831,536 | S | * | 10/2018 | Hung | D11/221 |
| D848,311 | S | * | 5/2019 | Hung | D11/221 |
| 2017/0224062 | A1 | * | 8/2017 | Hsu | A44B 19/36 |
| 2019/0059525 | A1 | * | 2/2019 | Hung | A44B 19/26 |

* cited by examiner

SLIDER FOR SLIDE FASTENER

CROSS-REFERENCE TO RELATED APPLICATION

The present application is a divisional application of U.S. application Ser. No. 15/823,541 filed on Nov. 27, 2017, which is a continuation application of PCT application No. PCT/CN2016/105789 filed on Nov. 14, 2016, the contents of which are hereby incorporated by reference.

FIELD OF THE INVENTION

The present invention relates to the field of zipper, and more particularly to a slider.

BACKGROUND OF THE INVENTION

Zipper is fastenings to combine or separate items with continuous teeth, now it is widely used in clothes, bags, tents and so on. Zipper comprises teeth, slider, top stopper, bottom stopper, and locking pieces and so on, wherein slider is moving parts that make the teeth engage with or separate from each other. Generally there are two tapes for the zipper with a sequence of teeth respectively, said sequence of teeth are alternatively staggered arranged; the slider clamps the teeth at both sides and slide with the aid of a pull-tab, thus making the teeth engage with or separate from each other.

Slider is the one of the slider fastener with automatically re-boundable function. Slider is widely used in jeans wear because of its anti-detergence and high machinability. The application CN105795617A discloses a slider comprises a slider base, the pull-tab, a connecting shaft and a spring; the slider base comprising an upper blade, a lower blade, and a connecting pin connecting the upper blade and the lower blade; wherein, upper blade lateral sides are formed on two sides of the upper blade, each of the upper blade lateral sides has two through-holes, comprising a first through-hole and a second through-hole, for mounting the connecting shaft; the upper blade further comprises a square-shaped notch for disposing the pull-tab; the square-shaped notch comprises an arc-shaped notch, an anterior-end-face of the arc-shaped notch connects to sidewalls of the square-shaped notch and a posterior-end-face of the arc-shaped notch connects to a bottom surface of the square-shaped notch; a locking through-hole is disposed at a joint portion between the square-shaped notch and the arc-shaped notch; the locking through-hole separates the arc-shaped notch into a first arc-shaped notch on a side of the first through-hole and a second arc-shaped notch on a side of the second through-hole; an anterior-end platform is disposed at a joint portion between the anterior-end-face of the first arc-shaped notch and the sidewalls of the square-shaped notch, and a posterior-end-face of the first arc-shaped notch connects to the bottom surface by a locking vertical plane; a posterior-end-face of the second arc-shaped notch connects to the bottom surface directly and an anterior-end-face of the second arc-shaped notch connects to the sidewalls of the square-shaped notch; the anterior-end-face platform has a lug boss at the second arc-shaped notch;

The pull-tab comprises a pull-tab body, a top-end-face of the pull-tab body has a spring mounting part and a locking part, wherein the spring mounting part and the locking part are adjacent to each other; the spring mounting part has a cambered surface and the locking part has a locking cambered surface that is lower than the spring mounting part; the top-end-face of the pull-tab body also has a connecting shaft through-hole for assembling the connecting shaft so as to fix the pull-tab to the slider base; the spring mounting part has a spring mounting hole coaxially provided with the connecting shaft through-hole, and a radius of the spring mounting hole is larger than a radius of the connecting shaft through-hole; a lateral side of the pull-tab body has a spring fixing hole communicating with the spring mounting hole;

Two ends of the spring has a first extending end and a second extending end, wherein the first extending end has a corner; when the slider is assembled, the spring is fit in the spring mounting hole; wherein the corner is disposed at a joint portion between the lug boss and the second arc-shaped notch; the second extending end inserts into the spring fixing hole; when the slider is assembled, the spring is in a compressed state.

The above mentioned slider have a very complex structure, inconvenient installation, high production cost and isn't beneficial to mass production.

SUMMARY OF THE INVENTION

The present invention aims at overcoming the defects of the prior art and providing a new-type slider which has a simple structure, low production cost and is easy to install.

In order to achieve above-mentioned goals, the first aspect of the present invention is as follows: a slider, comprises a slider base, a pull-tab, a connecting shaft and a spring; the slider base comprising an upper blade, a lower blade, and a connecting pin connecting the upper blade and the lower blade;

said pull-tab is integrated with the connecting shaft; the pull-tab comprises a pull-tab body, with a spring mounting part and a locking part set at the anterior-end of the pull-tab body, wherein the spring mounting part and the locking part are adjacent to each other; the anterior-end-face of the pull-tab body is set as a locking vertical plane and the anterior-end bottom of the pull-tab body is set as cambered surface; the connecting shaft is fixed to the anterior-end of the pull-tab body and the length of the connecting shaft is larger than the width of the anterior-end-face of the pull-tab body; the connecting shaft runs through the spring mounting part and the locking part and extends to both sides of the anterior-end of the pull-tab body; the spring mounting part has a spring mounting hole for mounting the spring set and twisting the connecting shaft; a spring mounting slot interconnected with the spring mounting hole is extended along the tangential direction of the spring mounting hole;

the upper blade has a square-shaped notch for disposing the pull-tab; the square-shaped notch comprises a further sunken concave surface, which matches with the bottom cambered surface at the anterior-end of the pull-tab body; the anterior-end of the sunken concave surface connects to the anterior-end of the square-shaped notch and forms a lug boss at the anterior-end of the square-shaped notch, and the rear-end of the sunken concave surface connects to the rear-end plane of the square-shaped notch; the anterior-end of the square-shaped notch and the upper blade forms a vertical plane, and both sides of the square-shaped notch has a first upper blade lateral side and a second upper blade lateral side set at both sides of the upper blade;

two raised convex parts are set on the first upper blade lateral side, and said two raised convex parts and the first upper blade lateral side forms a U-shaped groove; a first connecting-shaft through hole is formed with the two raised convex parts riveted to each other through the interior of the U-shaped groove; a second connecting-shaft through hole is set at the second upper blade lateral side; the second connecting-shaft through hole comprises a spring assembling hole and a conducting slot interconnected with the spring assembling hole; the spring assembling hole and conducting slot match with the spring mounting hole and the spring mounting slot set at the anterior-end of the pull-tab body, and an annular slot with a gap is also set on the second upper blade lateral side;

a first extending end and a second extending end are set at two ends of the spring, wherein the second extending end has a corner; when the slider is assembled, the connecting shaft integrated with the pull-tab and the second connecting-shaft through hole sets the pull-tab on the upper blade of the base by the U-shaped groove; a first connecting-shaft through hole is formed with the two raised convex parts on the first upper blade lateral side riveting to each other through the interior of the U-shaped groove, so as to fix the pull-tab to the upper blade on the slider base; the spring is assembled by the spring assembling hole and conducting slot set at the second upper blade lateral side, when it is assembled, the spring gets into the spring mounting hole through the spring assembling hole, and the second extending end having a corner gets into the spring mounting slot through the conducting slot; when the spring is assembled and fixed, the spring is in a compressed state, the first extending end of the spring would clip into the annular slot and withstood by the annular slot.

In order to achieve above-mentioned goals, the second aspect of the present invention is as follows: a slider, comprises a slider base, a pull-tab, a connecting shaft and a spring; the slider base comprises an upper blade, a lower blade, and a connecting pin connecting the upper blade and the lower blade;

said pull-tab is integrated with the connecting shaft; the pull-tab comprises a pull-tab body, with a spring mounting part and a locking part set at the anterior-end of the pull-tab body, wherein the spring mounting part and the locking part are adjacent to each other; the anterior-end-face of the locking part is set as a locking vertical plane and the bottom of the locking part is set as cambered surface; an interconnected gap is set between the anterior-end-face of the spring mounting part and the bottom of the spring mounting part; the connecting shaft is fixed to the anterior-end of the pull-tab body and the length of the connecting shaft is larger than the width of the anterior-end of the pull-tab body; the connecting shaft runs through the spring mounting part and the locking part, and is set with a bias towards the anterior-end of the locking part and extends to both sides of the anterior-end of the pull-tab body; the spring mounting part has a spring mounting hole with a gap, which is set twisting the connecting shaft; a spring mounting slot interconnected with the spring mounting hole and tangent to the spring mounting hole with a gap is formed when the bottom of the spring mounting part extends towards the pull-tab body;

the upper blade has a square-shaped notch for disposing the pull-tab; the square-shaped notch comprises an further sunken concave surface, which matches with the bottom cambered surface at the anterior-end of the locking part of the pull-tab; the anterior-end of the sunken concave surface connects to the anterior-end of the square-shaped notch and forms a lug boss at the anterior-end of the square-shaped notch, and the rear-end of the sunken concave surface connects to the rear-end plane of the square-shaped notch; the anterior-end of the square-shaped notch and the upper blade forms a vertical plane, and both sides of the square-shaped notch has a first upper blade lateral side and a second upper blade lateral side set at both sides of the upper blade;

two raised convex parts are set on the first upper blade lateral side, and said two raised convex parts and the first upper blade lateral side forms a U-shaped groove; a first connecting-shaft through hole is formed with the two raised convex parts riveting to each other through the interior of the U-shaped groove; a second connecting-shaft through hole is set at the second upper blade lateral side; the second connecting-shaft through hole comprises a spring assembling hole and a conducting slot interconnected with the spring assembling hole; the spring assembling hole and conducting slot matches with the spring mounting hole and spring mounting slot set at the anterior-end-face of the pull-tab body, and an annular slot with a gap is also set on the second upper blade lateral side;

a first extending end and a second extending end are set at two ends of the spring, wherein the second extending end has a corner; when the slider is assembled, the connecting shaft integrated with the pull-tab and the second connecting-shaft through hole sets the pull-tab on the upper blade of the slider base by the U-shaped groove; a first connecting-shaft through hole is formed with the two raised convex parts on the first upper blade lateral side riveting to each other through the interior of the U-shaped groove, so as to fix the pull-tab to the upper blade on the slider base; the spring is assembled by the spring assembling hole and conducting slot set at the second upper blade lateral side, when it is assembled, the spring gets into the spring mounting hole through the spring assembling hole, the second extending end having a corner gets into the spring mounting slot through conducting slot; when the spring is assembled and fixed, the spring is in a compressed state, the first extending end of the spring would clip into the annular slot and withstood by the annular slot.

The structure of the pull-tab disclosed by the second aspect is applicable to small-size sliders, said structure of the pull-tab reduces the relative altitude of the small-size slider and adjusts the small-size slider to a more reasonable proportion, thus increasing the practicability of the small-size slider.

Preferably, the first upper blade lateral side and the second upper blade lateral side extend towards the rear-end-face of the upper blade up to the rear-end of the upper blade.

Preferably, the first upper blade lateral side and the second upper blade lateral side extends towards the rear-end-face of the upper blade up to the middle of the rear-end plane of the square-shaped notch, and forms step-shaped structure with the rear-end plane.

Both the first upper blade lateral side and the second upper blade lateral side extend towards the rear-end-face of the upper blade so as to prevent the locking head from scratching when a lock slider is in use.

Preferably, a lug boss is set at the first upper blade lateral side but closer to rear-end of the upper blade, and a notch is set between the lug boss and the convex part closer to the lug boss.

Preferably, the notch is a curved notch.

Preferably, said curved notch is smoothly transitionally connected with the lug boss and the convex part closer to the lug boss.

The notch could prevent the convex part set on the first upper blade lateral side but closer to the lug boss from fracturing because of excessive force during the riveting process.

Preferably, a first platform is extended with outwards at the first upper blade lateral side, and a second platform is extended with outwards at the second upper blade lateral side.

Preferably, said first platform or second platform is set as curved platform, said first platform matches with the first connecting-shaft through hole, and said second platform matches with the second connecting-shaft through hole.

Preferably, said concave surface has a locking through hole, which is set closer to the first connecting-shaft through hole; a locking head is set at the bottom of the locking part and matching with the locking through hole. The locking through hole and locking head could prevent the pull-tab from sliding because of strong external force during use.

Preferably, a slot platform is set at the lower-end of the annular slot, and the side surface of the slot platform withstands the bottom part of the first extending end of the spring. The slot platform could prevent the spring from elastic deformation, losing of elasticity or popping because of spring rotation during use.

Preferably, a lower blade sunk platform which sags inward towards the lower surface of the lower blade respectively at both sides of the upper surface of the lower blade closer to the connecting pins.

Preferably, an upper blade sunk platform which sags inward towards the upper surface of the upper blade respectively at both sides of the lower surface of the upper blade closer to the connecting pins.

Said lower blade sunk platform and upper blade sunk platform could improve the smoothness in the slider zipping and unzipping the zipper during use.

Preferably, a protruding platform is set on the side surface of the pull-tab body closer to one side of the first connecting-shaft through hole at the point the connecting shaft is connected with, said protruding platform is set at both ends of the connecting shaft and extending along the length direction of the pull-tab. The protruding platform could prevent the slider from direct friction of the pull-tab and the first upper blade lateral side of the upper blade on the slider base when the pull-tab rotates in use and resulting in difficult rotation.

Preferably, at least one pull-tab through hole is set on the pull-tab body, and when there is more than one pull-tab through hole is set on the pull-tab body, said pull-tab through holes are set regularly along the length direction of the pull-tab.

Preferably, the pull-tab through hole is set closer to the rear-end of the pull-tab body.

Preferably, the pull-tab through hole is set as squared-shape.

Said pull-tab through hole could improve the stability of the pull-tab when it is assembled.

Preferably, both ends of the connecting shaft is set as truncated cone shape, which could facilitate the assembly and disassembly of the pull-tab and reduce the pivoting friction of the connecting shaft when the slider is in use, thus prolonging the service life of the pull-tab and the slider.

Preferably, the length of the connecting shaft is set as 1.8~2.3 times of the anterior-end width of the pull-tab body, the ratio of the length of the connecting shaft to the anterior-end width of the pull-tab body is set as the same with the befitting length of the connecting shaft to the pull-tab and slider base, which could guarantee the pull-tab set on a preferable position on the slider base and facilitate the assembly of the slider.

Preferably, the depth of the spring mounting hole is set as ½~⅔ of the length of the spring, the ratio of the depth of the spring mounting hole to the length of the spring works in combination with the spring mounting hole, the spring assembling hole on the second upper blade lateral side and the spring structure, thus making the first extending end of the spring clip into the annular slot on the second upper blade lateral side when the slider is assembled, and ensuring the stability of the spring when the slider is assembled.

The invention has the advantages that the slider disclosed by the present invention comprises a slider base, a pull-tab, a connecting shaft and a spring; said pull-tab is integrated with the connecting shaft; a spring mounting part and a locking part is set at the anterior-end of the pull-tab body, wherein the spring mounting part and the locking part are adjacent to each other; the spring mounting part has a spring mounting hole and a spring mounting slot interconnected with the spring mounting hole; the upper blade has a square-shaped notch for disposing the pull-tab, a first upper blade lateral side and a second upper blade lateral side set at both sides of the square-shaped notch; a first connecting-shaft through hole and a second connecting-shaft through hole is set at the first upper blade lateral side and the second upper blade lateral side respectively; the second connecting-shaft through hole matches with the spring mounting hole and spring mounting slot set on the spring mounting part. The structure of the slider disclosed by the present invention is a new technical design with simplified structure and is facilitated for industrialized production with low cost. The pull-tab is integrated with the connecting shaft, which facilitates the slider mounting on the upper slider on the slider base. When the pull-tab is assembled, the spring gets into the spring mounting part at the anterior-end of the pull-tab and is assembled through the second connecting-shaft through hole, thus simplifying assembly technique and steps of the slider, which facilitates the assembly of the slider and improves the production efficiency of slider, and achieves steady structure and long service life of the slider after it is assembled.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

Figure 1:
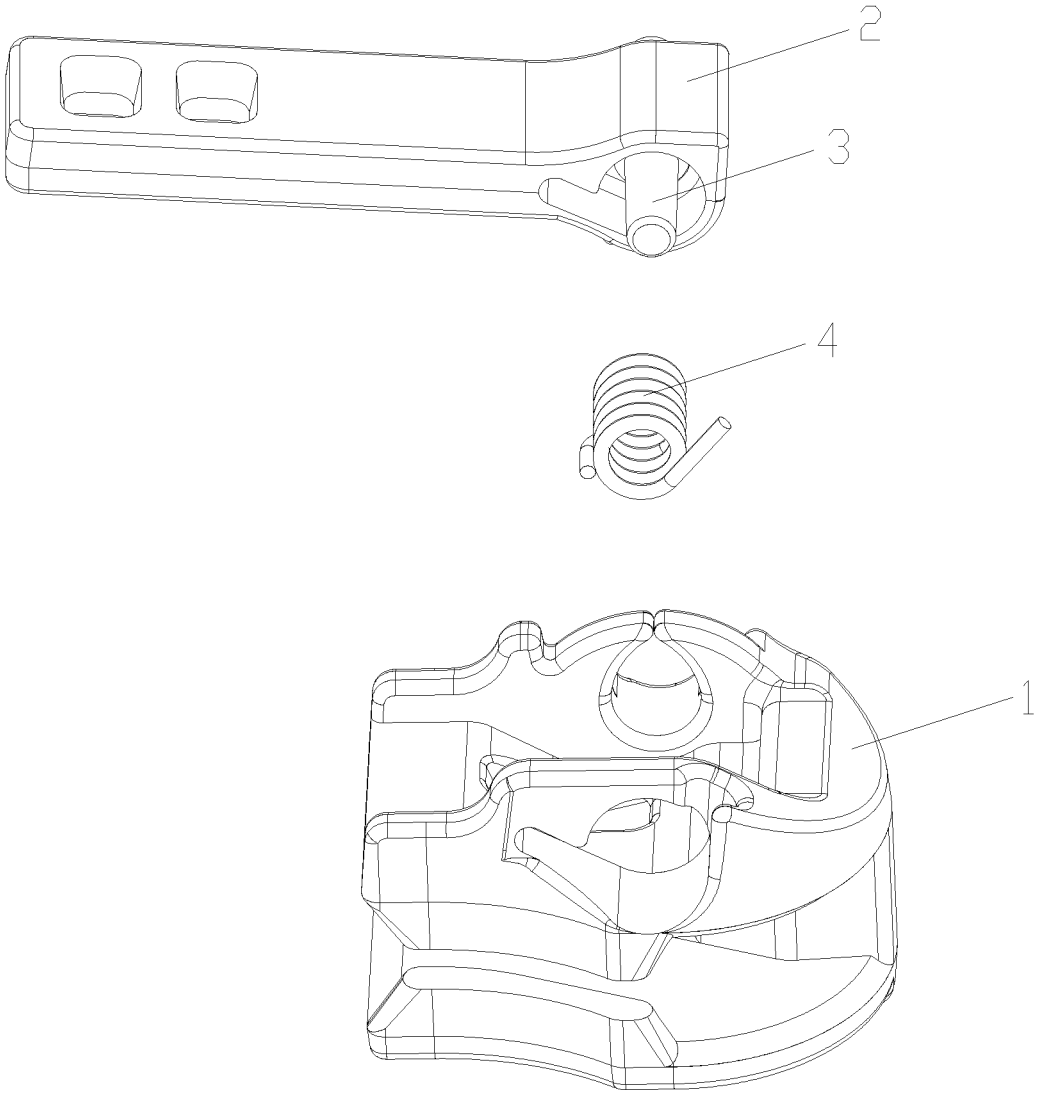
FIG. 1 is a exploded view of the slider disclosed by the embodiment 1 of the present invention.

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Embodiment 1

Refer to FIG. 1 to FIG. 13, the slider disclosed by the present invention, comprising: a slider base 1, a pull-tab 2, a connecting shaft 3 and a spring 4; the slider base 1 comprises an upper blade 11, a lower blade 13, and a connecting pin 12 connecting the upper blade 11 and the lower blade 13;

said pull-tab 2 is integrated with the connecting shaft 3; the pull-tab 2 comprises a pull-tab body 21, with a spring mounting part 22 and a locking part 23 set at the anterior-end of the pull-tab body 21, wherein the spring mounting part 22 and the locking part 23 are adjacent to each other; the anterior-end-face of the pull-tab body 21 is set as a locking vertical plane 24 and the bottom of the pull-tab body 21 is set as cambered surface; the connecting shaft 3 is fixed to the anterior-end of the pull-tab body 21 and the length of the connecting shaft 3 is larger than the width of the anterior-end of the pull-tab body 21; the connecting shaft 3 runs through the spring mounting part 22 and the locking part 23 and extends to both sides of the anterior-end of the pull-tab body 21; the spring mounting part 22 has a spring mounting hole 221 for mounting the spring 4 which is set and twisting the connecting shaft 3; a spring mounting slot 222 interconnected with the spring mounting hole 221 is extended along with the tangential direction of the spring mounting hole 221;

the upper blade 11 has a square-shaped notch 1101 for disposing the pull-tab 2; the square-shaped notch 1101 comprises an further sunken concave surface 1102, which matches with the bottom cambered surface at the anterior-end of the pull-tab body 21; the anterior-end of the sunken concave surface 1102 connects to the anterior-end of the square-shaped notch 1101 and forms a lug boss 1103 at the anterior-end of the square-shaped notch 1101, and the rear-end of the sunken concave surface 1102 connects to the rear-end plane 1104 of the square-shaped notch 1101; the anterior-end of the square-shaped notch 1101 and the upper blade 11 forms a vertical plane 1105, and both sides of the square-shaped notch 1101 has a first upper blade lateral side 1106 and a second upper blade lateral side 1107 set at both sides of the upper blade 11;

two raised convex parts 1108 are set on the first upper blade lateral side 1106, and said two raised convex parts 1108 and the first upper blade lateral side 1106 forms a U-shaped groove; a first connecting-shaft through hole 1109 is formed with the two raised convex parts 1108 riveting to each other through the interior of the U-shaped groove; a second connecting-shaft through hole 1110 is set at the second upper blade lateral side 1107; the second connecting-shaft through hole 1110 comprises a spring assembling hole 1111 and a conducting slot 1112 interconnected with the spring assembling hole 1111; the spring assembling hole 1111 and conducting slot 1112 matches with the spring mounting hole 221 and the spring mounting slot 222 set at the anterior-end of the pull-tab body 21, and an annular slot 1113 with a gap is also set on the second upper blade lateral side 1107;

a first extending end 41 and a second extending end 42 are set at two ends of the spring 4, wherein the second extending end 42 has a corner 421; when the slider is assembled, the connecting shaft 3 integrated with the pull-tab 2 and the second connecting-shaft through hole 1110 sets the pull-tab 2 on the upper blade 11 on the slider base 1 by the U-shaped groove; a first connecting-shaft through hole 1109 is formed with the two raised convex parts 1108 on the first upper blade lateral side 1106 riveting to each other through the interior of the U-shaped groove, so as to fix the pull-tab 2 to the upper blade 11 of the slider base 1; the spring 4 is assembled by the spring assembling hole 1111 and conducting slot 1112 set at the second upper blade lateral side 1107, when it is assembled, the spring 4 gets into the spring mounting hole 221 through the spring assembling hole 1111, the second extending end 42 having a corner 421 gets into the spring mounting slot 222 through conducting slot 1112; when the spring 4 is assembled and fixed, the spring 4 is in a compressed state, the first extending end 41 of the spring 4 would clip into the annular slot 1113 and withstood by the annular slot 1113.

The present invention discloses a slider, comprising a slider base 1, a pull-tab 2, a connecting shaft 3 and a spring 4; the pull-tab 2 is integrated with the connecting shaft 3; a spring mounting part 22 and a locking part 23 is set at the anterior-end-face of the pull-tab body 21, wherein the spring mounting part 22 and the locking part 23 are adjacent to each other; the connecting shaft 3 is fixed to the anterior-end of the pull-tab body 21; the connecting shaft 3 runs through the spring mounting part 22 and the locking part 23; the spring mounting part 22 has a spring mounting hole 221 and a spring mounting slot 222 interconnected with the spring mounting hole 221;

the upper blade 11 on the slider base 1 has a square-shaped notch 1101 for disposing the pull-tab 2; and both sides of the square-shaped notch 1101 has a first upper blade lateral side 1106 and a second upper blade lateral side 1107;

a first connecting-shaft through hole 1109 and a second connecting-shaft through hole 1110 is set respectively at the first upper blade lateral side 1106 and the second upper blade lateral side 1107; the second connecting-shaft through hole 1110 matches with the spring mounting hole 221 on the spring mounting part 22 and the spring mounting slot 222. The structure of the slider disclosed by the present invention is a new technical design with simplified structure and is facilitated for industrialized production with low cost. The pull-tab 2 is integrated with the connecting shaft 3, which facilitates the slider mounting on the upper slider 11 of the slider base 1. When the pull-tab 2 is assembled, the spring 4 assembled with the spring mounting part 22 on the anterior-end of the pull-tab body 21 through the second connecting-shaft through hole 1110, thus simplifying assembly technique and steps of the slider, which facilitates the assembly of the slider and improves the production efficiency of slider, and achieves steady structure and long service life of the slider after it is assembled.

Figure 2:
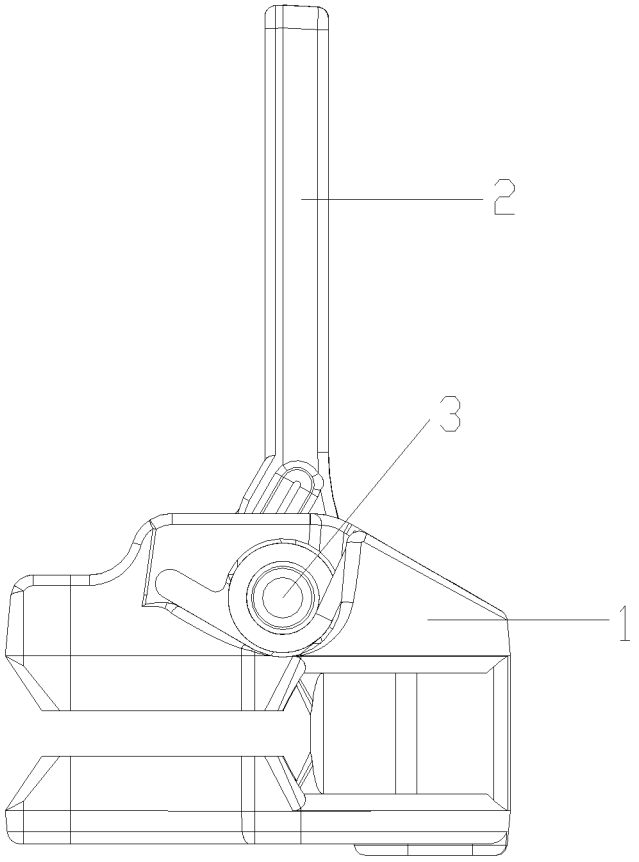
FIG. 2 is a schematic view of the pull-tab of the present invention when it is assembled on the slider base.

Refer to FIG. 1, FIG. 2, FIG. 4 and FIG. 6, wherein FIG. 2 is a schematic view of the pull-tab of the present invention when it is assembled on the slider base. The pull-tab 2 assembled on the slider base 1 of the present invention rotates approximate to 90°. When the pull tab 2 rotates gradually to the state shown in FIG. 2, locking vertical plane 24 at the anterior-end of the pull-tab body 21 withstands the lug boss 1103 at the anterior-end-face of the square-shaped notch 1101 so as to limit the rotation angle of the pull-tab 2 and reduce the force exerted on the spring 4, thus prolonging the service life of the spring 4 and the slider.

Figure 3:
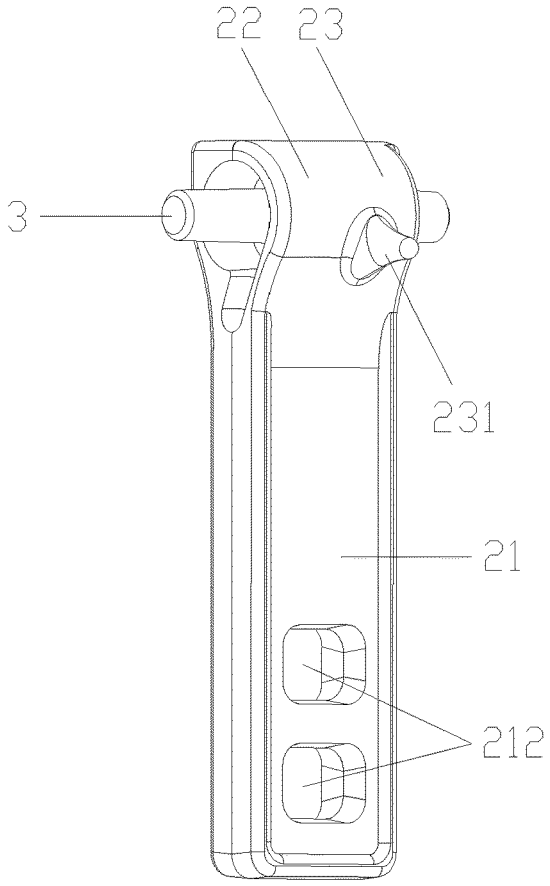
FIG. 3 is a schematic view of the pull-tab disclosed by the embodiment 1 of the present invention.
Figure 6:
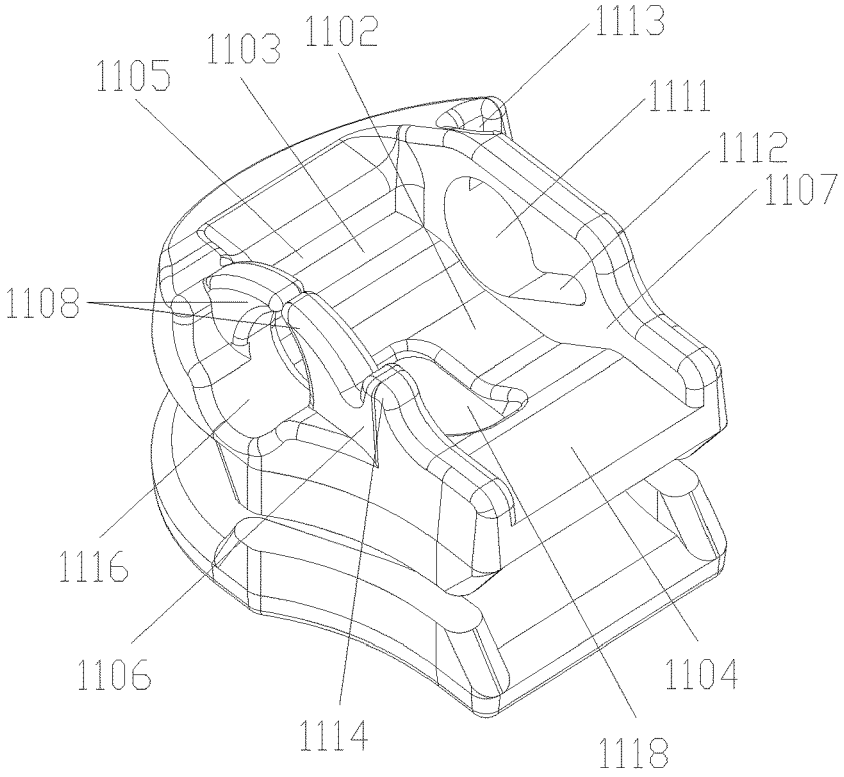
FIG. 6 is a first schematic view of the slider base of the present invention.
Figure 7:
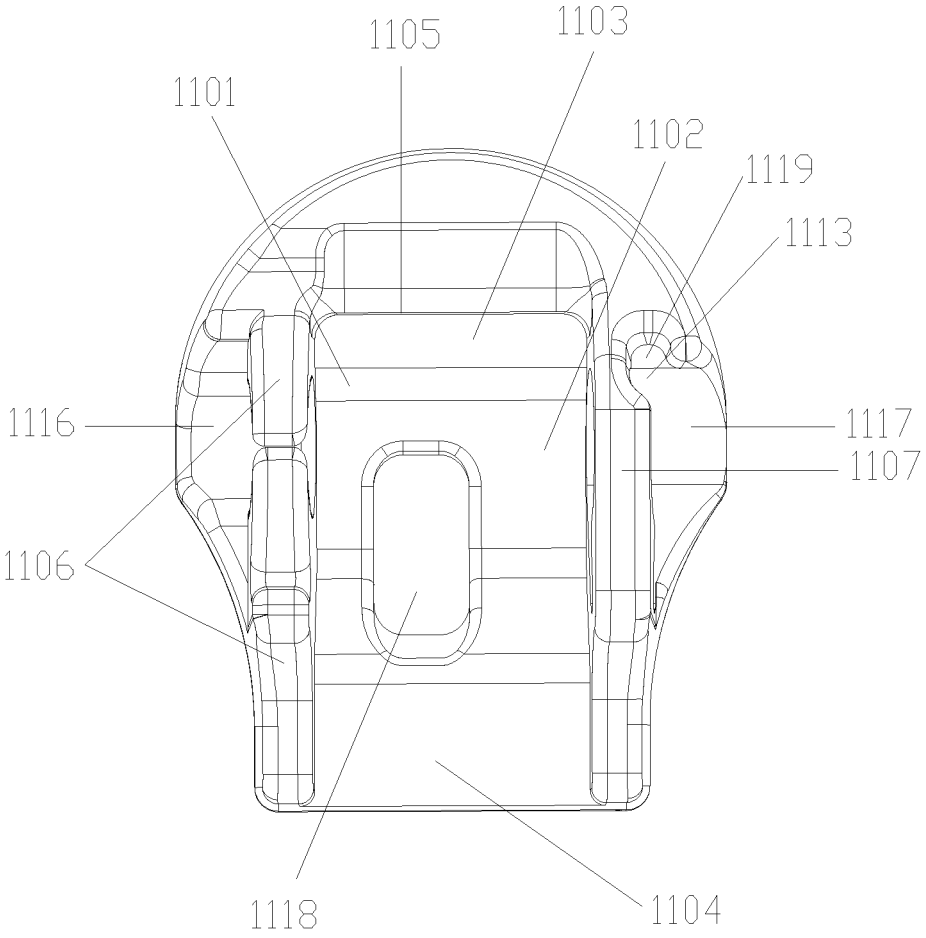
FIG. 7 is a schematic view of the vertical structure of the slider base disclosed by the present invention.
Figure 8:
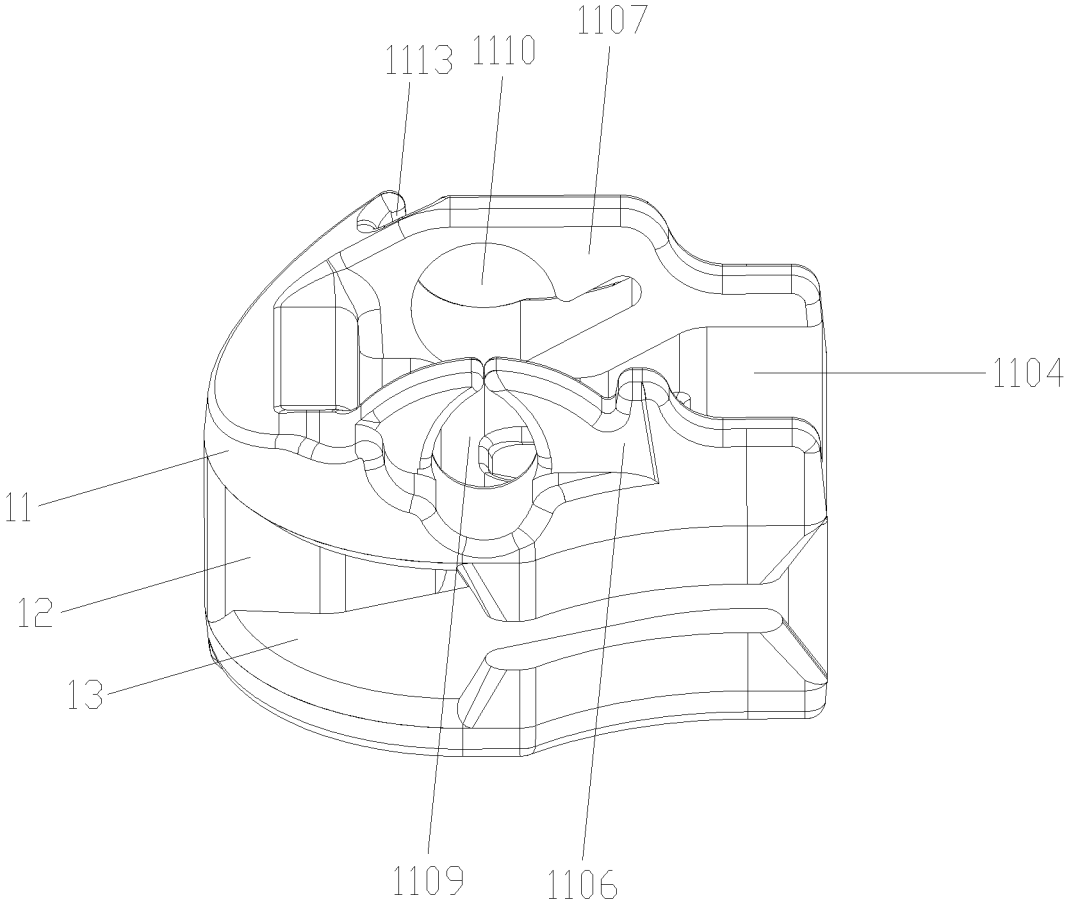
FIG. 8 is a first schematic view of the side structure of the slider base disclosed by the present invention.
Figure 9:
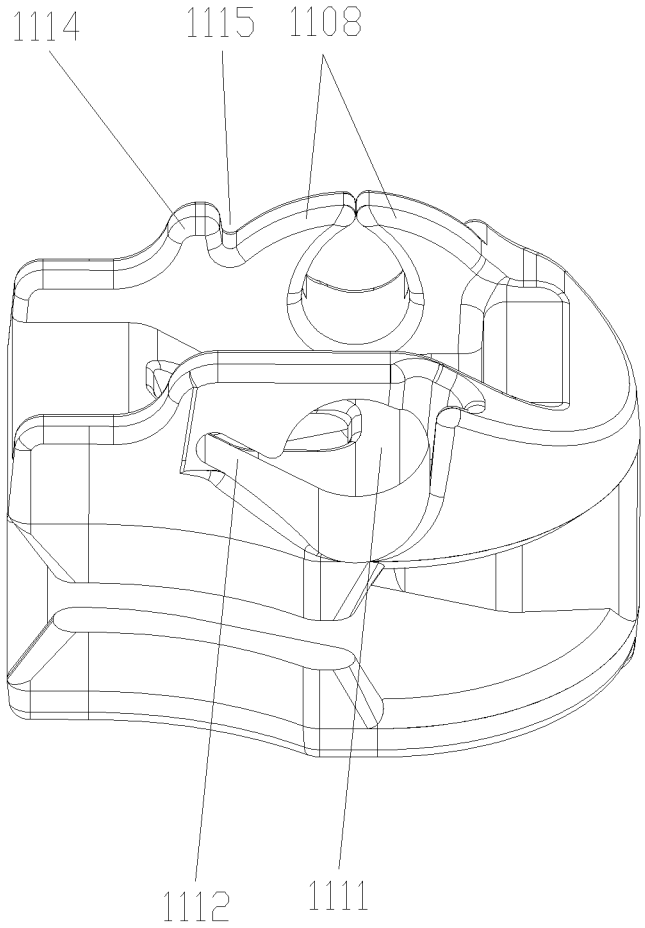
FIG. 9 is a second schematic view of the side structure of the slider base disclosed by the present invention.
Figure 10:
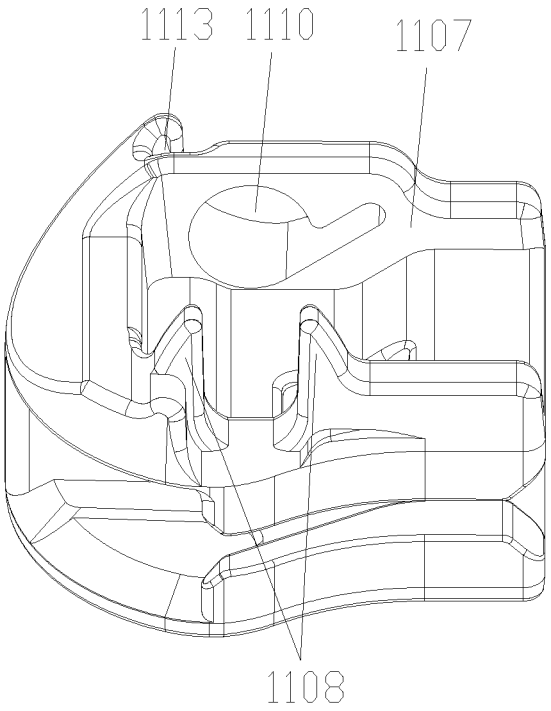
FIG. 10 is a schematic view of the slider base before riveting disclosed by the present invention.
Figure 11:
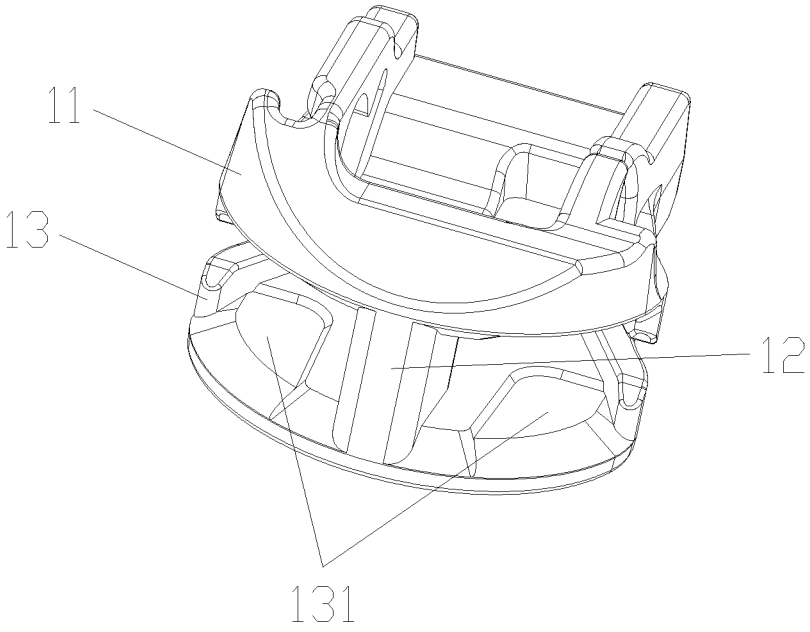
FIG. 11 is a second schematic view of the slider base disclosed by the present invention.
Figure 12:
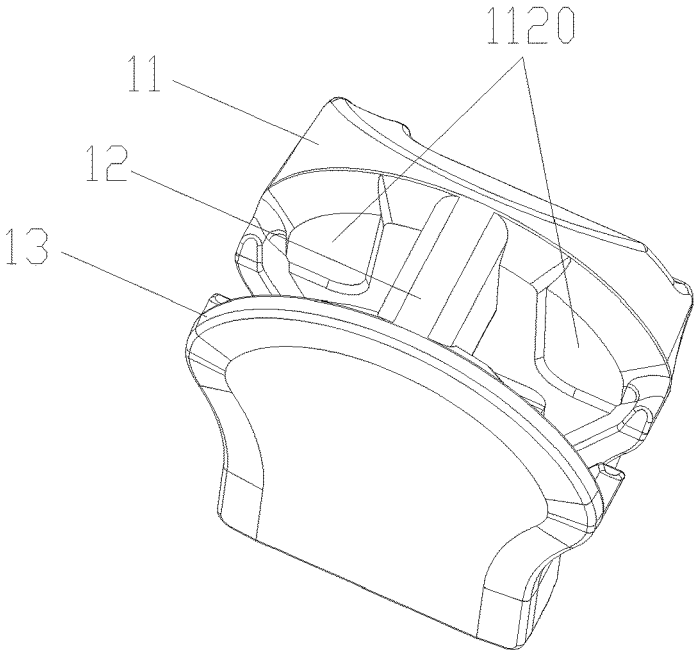
FIG. 12 is a third schematic view of the slider base disclosed by the present invention.
Figure 13:
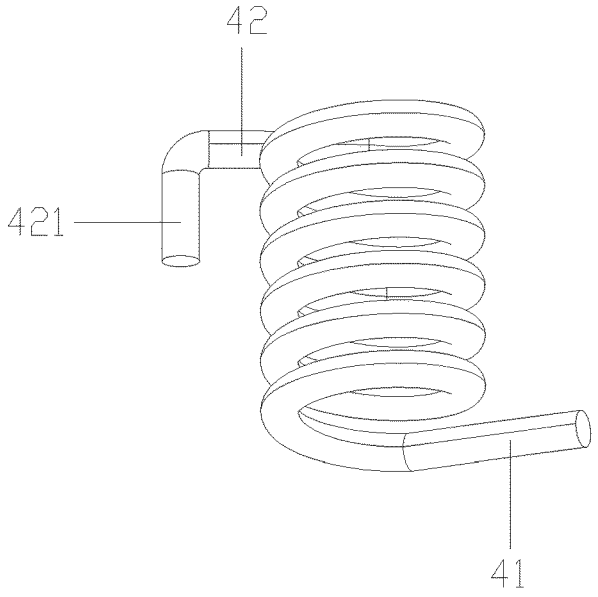
FIG. 13 is a schematic view of the spring disclosed by the present invention.
Figure 14:
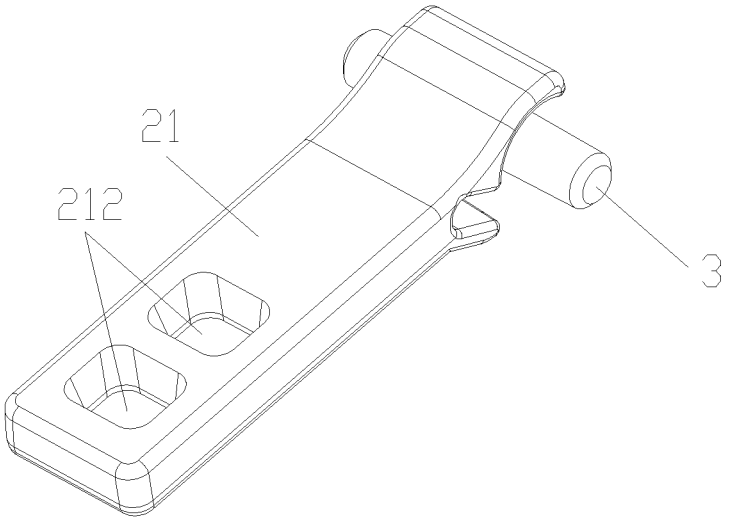
FIG. 14 is a schematic view of the pull-tab disclosed by embodiment 2 of the present invention.
Figure 15:
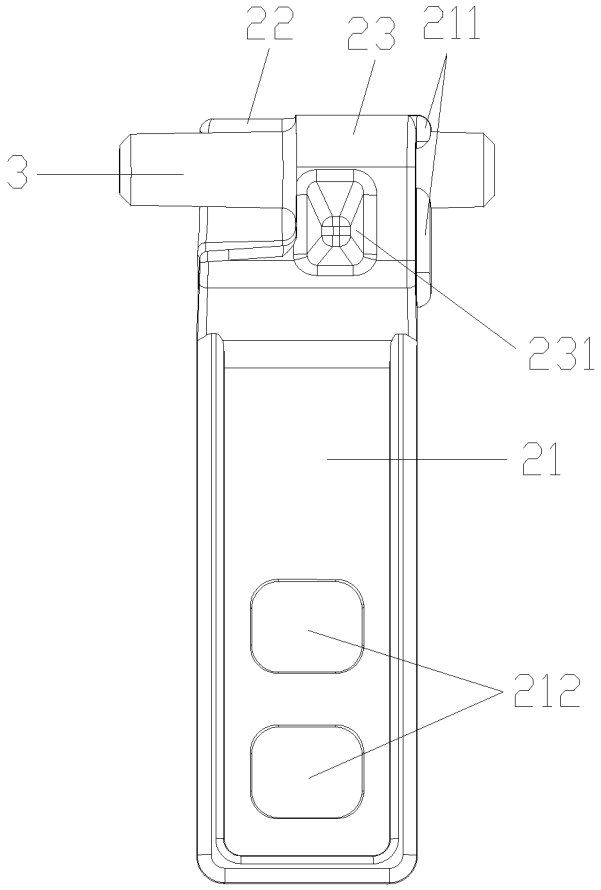
FIG. 15 is a schematic view of the back-side structure of the pull-tab disclosed by embodiment 2 of the present invention.
Figure 16:
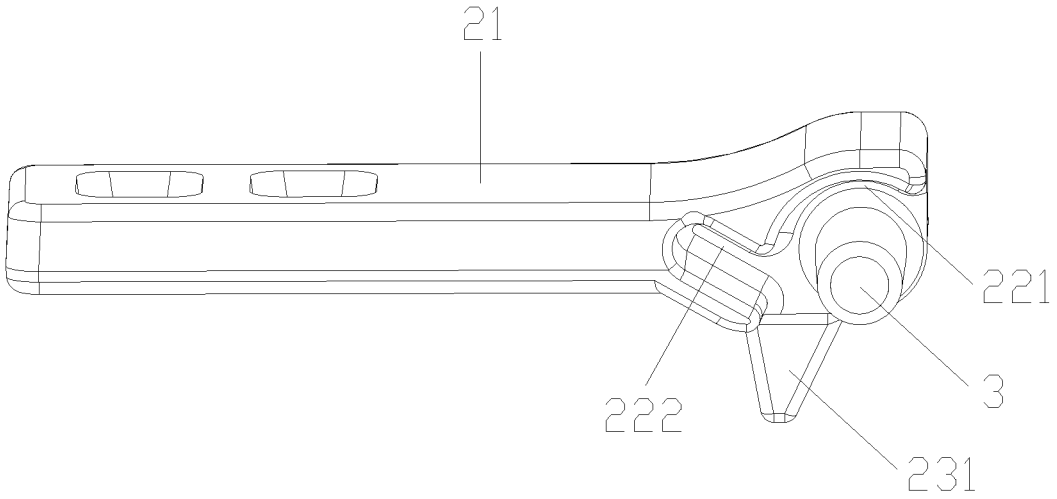
FIG. 16 is a first schematic view of the side structure of the pull-tab disclosed by embodiment 2 of the present invention.
Figure 17:
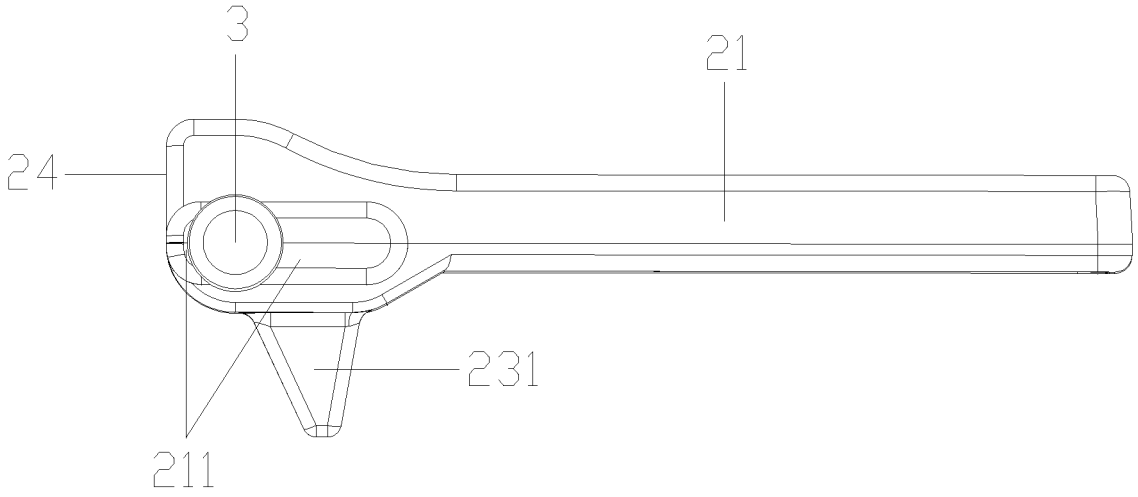
FIG. 17 is a second schematic view of the side structure of the pull-tab disclosed by embodiment 2 of the present invention.
Figure 18:
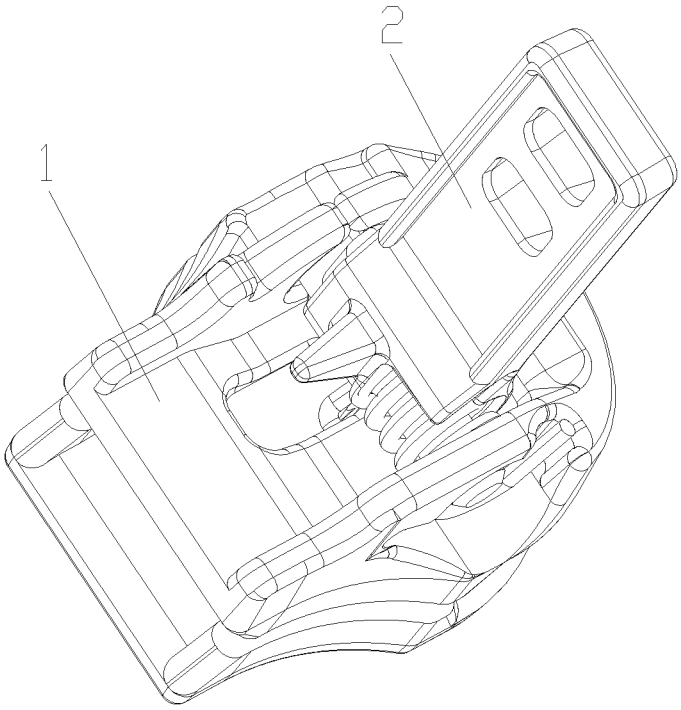
FIG. 18 is a schematic view of the pull-tab disclosed by embodiment 2 of the present invention when it is assembled on the slider base.
Figure 19:
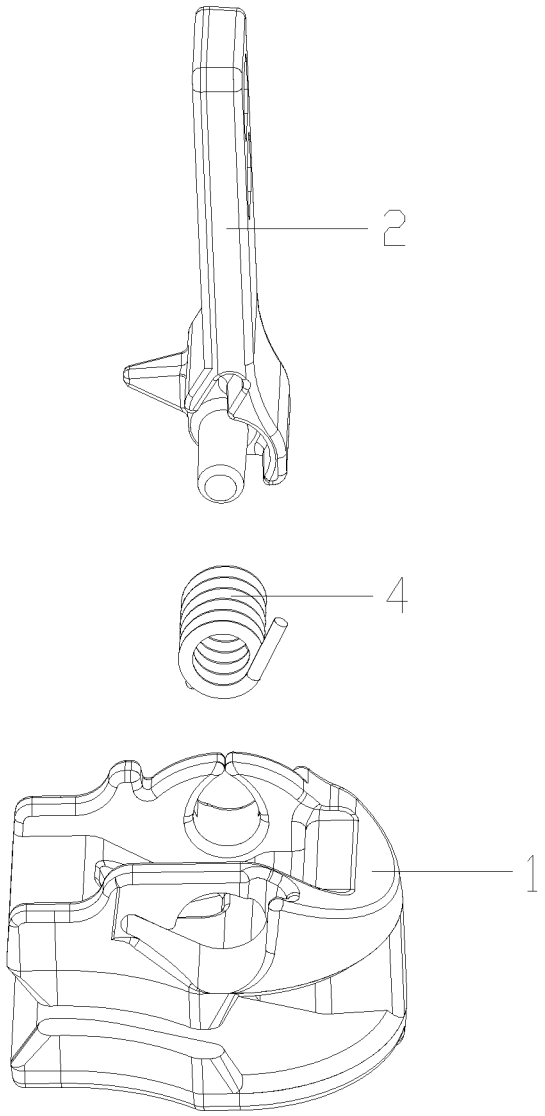
FIG. 19 is a exploded view of the slider disclosed by the embodiment 2 of the present invention

Specifically, refer to FIG. 3, FIG. 6 and FIG. 12, a locking through hole 1118 is set at the concave surface 1102 of the upper blade 11 of the slider base 1, the locking through hole 1118 is set closer to the first connecting-shaft through hole 1109; a locking head 231 is set at the bottom of the locking part 23 which is set at the anterior-end of the pull-tab body 21 and matching with the locking through hole 1118. The locking through hole 1118 and locking head 231 could prevent the pull-tab 2 from sliding because of strong external force during use.

The first upper blade lateral side 1106 and the second upper blade lateral side 1107 extend towards the rear-end-face of the upper blade 11 up to the rear-end of the upper blade or to the middle of the rear-end plane 1104 of the square-shaped notch 1101. When the first upper blade lateral side 1106 and the second upper blade lateral side 1107 extends towards the rear-end-face of the upper blade 11 up to the middle of the rear-end plane 1104 of the square-shaped notch 1101, the first upper blade lateral side 1106, the second upper blade lateral side 1107 and the rear-end plane 1104 forms step-shaped structure. Both the first upper blade lateral side 1106 and the second upper blade lateral side 1107 extend towards the rear-end-face of the upper blade 11 so as to prevent locking head 231 from scratching when a slider with a locking head 231 is in use.

A lug boss 1114 is set at the first upper blade lateral side 1106 but closer to the rear-end of the upper blade 11, and a notch 1115 is set between the lug boss 1114 and the convex part 1108 closer to the lug boss 1114. In this embodiment, the notch 1115 is a curved notch. The curved notch is smoothly transitionally connected with the lug boss 1114 and the convex part 1108 closer to the lug boss 1114. The notch 1115 could prevent the convex part 1108 set on the first upper blade lateral side 1106 but closer to the lug boss 1114 from fracturing because of excessive force during the riveting process.

A first platform 1116 is extended with outwards at the first upper blade lateral side 1106, and a second platform 1117 is extended with outwards at the second upper blade lateral side 1107. In this embodiment, the first platform 1116 or second platform 1117 is set as curved platform. The first platform 1116 matches with the first connecting-shaft through hole 1109, and the second platform 1117 matches with the second connecting-shaft through hole 1110. A slot platform 1119 is set at the lower-end of the annular slot 1113 on the second upper blade lateral side 1107, and the side surface of the slot platform 1119 withstands the bottom part of the first extending end 41 of the spring 4. The slot platform 1119 could prevent the spring 4 from elastic deformation, losing of elasticity or popping because of spring rotating during use.

A lower blade sunk platform 131 which sags inward towards the lower surface of the lower blade 13 respectively at both sides of the upper surface of the lower blade closer to the connecting pins 12. An upper blade sunk platform 1120 which sags inward towards the upper surface of the upper blade 11 respectively at both sides of the lower surface of the upper blade 11 closer to the connecting pins 12. The lower blade sunk platform 131 and upper blade sunk platform 1120 could improve the smoothness in the slider zipping and unzipping the zipper during use.

Figure 4:
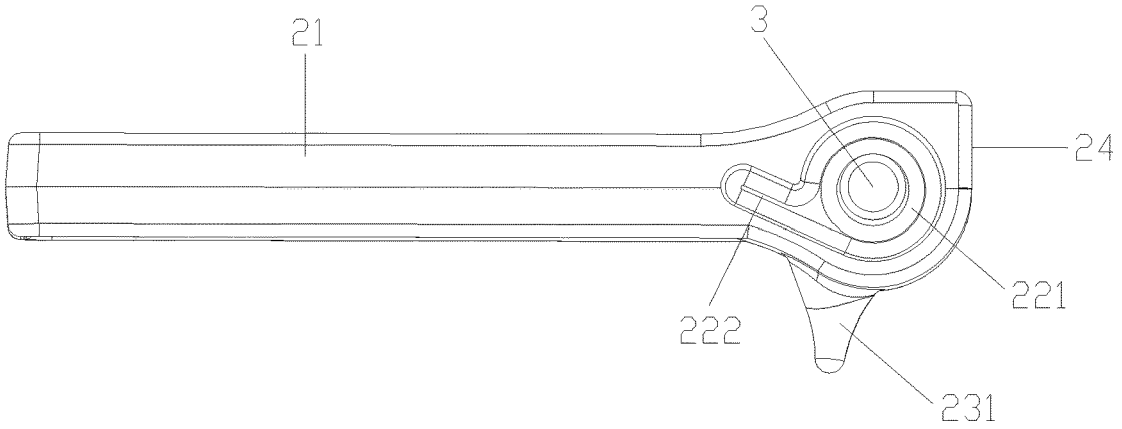
FIG. 4 is a first schematic view of the side structure of the pull-tab disclosed by the embodiment 1 of the present invention.
Figure 5:
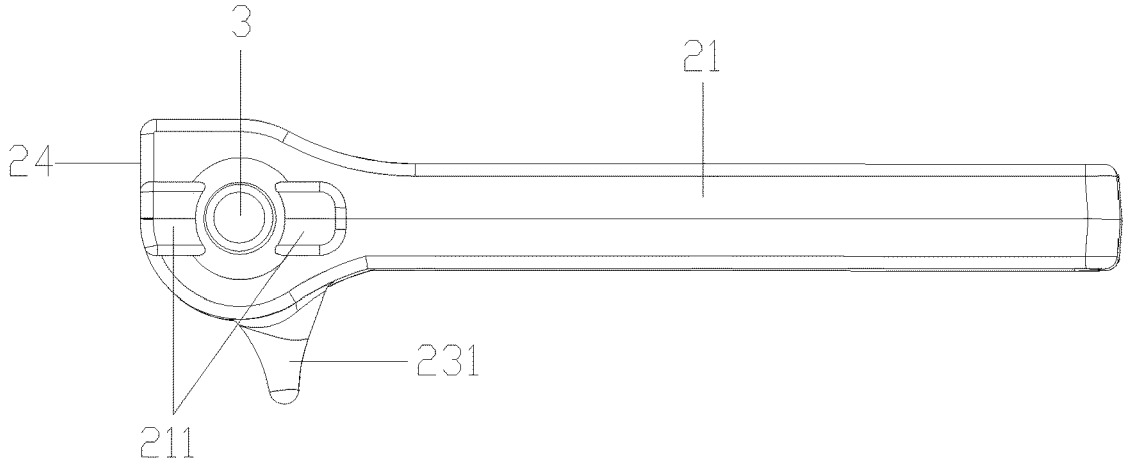
FIG. 5 is a second schematic view of the side structure of the pull-tab disclosed by the embodiment 1 of the present invention.

Refer to FIG. 3, FIG. 4 and FIG. 5, in this embodiment, a protruding platform 211 is set on the side surface of the pull-tab body 21 closer to one side of the first connecting-shaft through hole 1109 at the point which the connecting shaft 3 is connected with, and the protruding platform 211 is set at both ends of the connecting shaft 3 and extending along the length direction of the pull-tab 2. The protruding platform 211 could prevent the slider from direct friction of the pull-tab 2 and the first upper blade lateral side 1106 of the upper blade 11 on the slider base 1 when the pull-tab 2 rotates in use and resulting in difficult rotation.

Refer to FIG. 3, FIG. 4 and FIG. 5, at least one pull-tab through hole 212 is set on the pull-tab body 21, and when there is more than one pull-tab through hole 212 is set on the pull-tab body 21, the pull-tab through holes 212 are set regularly along the length direction of the pull-tab 2. And in this embodiment, the pull-tab through hole 212 is set closer to the rear-end of the pull-tab body 21. The pull-tab through hole 212 could improve the stability of the pull-tab when it is assembled.

Refer to FIG. 1, FIG. 3, FIG. 4, FIG. 5, FIG. 6 and FIG. 13, the depth of the spring mounting hole 221 is set as ½~⅔ of the length of the spring 4, the ratio of the depth of the spring mounting hole 221 to the length of the spring 4 works in combination with the spring mounting hole 221, the spring assembling hole 1111 on the second upper blade lateral side 1107 and structure of the spring 4, thus making the first extending end 41 of the spring 4 clip into the annular slot 1113 on the second upper blade lateral side 1107 when the slider is assembled, and ensuring the stability of the spring 4 when the slider is assembled.

Refer to FIG. 1, FIG. 3, FIG. 4 and FIG. 5, both ends of the connecting shaft 3 is set as truncated cone shape, which could facilitate the assembly and disassembly of the pull-tab 2 and reduce the pivoting friction of the connecting shaft 3 when the slider is in use, thus prolonging the service life of the pull-tab 2 and slider.

The length of the connecting shaft 3 is set as 1.8~2.3 times of the anterior-end width of the pull-tab body 21, the ratio of the length of the connecting shaft 3 to the anterior-end width of the pull-tab body 21 is set as the same with the befitting length of the connecting shaft 3 to the pull-tab 2 and slider base 1, which could guarantee the pull-tab 2 set at a preferable position on the slider base 1 and facilitate the assembly of the slider.

Embodiment 2

Refer to FIG. 14 to FIG. 19, the Embodiment 2 differs from Embodiment 1 that a spring mounting part 22 and a locking part 23 is set at the anterior-end of the pull-tab body 21, wherein the spring mounting part 22 and the locking part 23 are adjacent to each other; the anterior-end-face of the locking part 23 is set as a locking vertical plane 24 and the bottom of the locking part 23 is set as cambered surface; an interconnected gap is set between the anterior-end-face of the spring mounting part 22 and the bottom of the spring mounting part 22; the connecting shaft 3 is fixed to the anterior-end of the pull-tab body 21 and the length of the connecting shaft 3 is larger than the width of the anterior-end of the pull-tab body 21; the connecting shaft 3 runs through the spring mounting part 22 and the locking part 23 and is set closer to the anterior-end-face of the locking part 23, and extends to both sides of the anterior-end of the pull-tab body 21; the spring mounting part 22 has a spring mounting hole 221 with a gap; a spring mounting slot 222 interconnected with the spring mounting hole 221 and tangent to the spring mounting hole 221 with a gap is formed when the bottom of the spring mounting part 22 extends towards the pull-tab body 21.

The structure of the pull-tab disclosed in the embodiment is applicable to small-size sliders, said structure of the pull-tab reduces the relative altitude of the small-size slider and adjusts the small-size slider to a more reasonable proportion, thus increasing the practicability of the small-size slider.

While the invention has been described in terms of what is presently considered to be the most practical and preferred embodiments, it is to be understood that the invention needs not be limited to the disclosed embodiment. All the terms in the present invention is used for the sake of clarity and should not constitute or be considered to be a limitation to the invention. On the contrary, it is intended to cover various modifications and similar arrangements included within the spirit and scope of the appended claims which are to be accorded with the broadest interpretation so as to encompass all such modifications and similar structures.

What is claimed is:

1. A slider, comprising a slider base, a pull-tab, a connecting shaft and a spring; said slider base comprises an upper blade, a lower blade, and a connecting pin connecting the upper blade and the lower blade; wherein said pull-tab is integrated with the connecting shaft; the pull-tab comprises a pull-tab body, with a spring mounting part and a locking part set at an anterior-end of the pull-tab body; the spring mounting part and the locking part are adjacent to each other; the anterior-end-face of the pull-tab body is set as a locking vertical plane and the bottom of the pull-tab body is set as a cambered surface; the connecting shaft is fixed to the anterior-end of the pull-tab body and the length of the connecting shaft is larger than the width of the anterior-end of the pull-tab body; the connecting shaft runs through the spring mounting part and the locking part and extends to both sides of the anterior-end of the pull-tab body; the spring mounting part has a spring mounting hole for mounting the spring, and said spring mounting hole surrounds the connecting shaft; a spring mounting slot interconnected with the spring mounting hole is extended along a tangential direction of the spring mounting hole;

the upper blade has a square-shaped notch for disposing the pull-tab; the square-shaped notch comprises a further sunken concave surface, which matches with the bottom cambered surface at the anterior-end of the pull-tab body; the anterior-end of the sunken concave surface connects to the anterior-end of the square-shaped notch and forms a lug boss at the anterior-end of the square-shaped notch; the rear-end of the sunken concave surface connects to the rear-end plane of the square-shaped notch; the anterior-end of the square-shaped notch and the upper blade forms a vertical plane, and both sides of the square-shaped notch have a first upper blade lateral side and a second upper blade lateral side set at both sides of the upper blade;

two raised convex parts are set on the first upper blade lateral side, and said two raised convex parts and the first upper blade lateral side forms a U-shaped groove; a second connecting-shaft through hole is set at the second upper blade lateral side; the second connecting-shaft through hole comprises a spring assembling hole and a conducting slot interconnected with the spring assembling hole; the spring assembling hole and conducting slot matches with the spring mounting hole and the spring mounting slot set at the anterior-end of the pull-tab body, and an annular slot with a gap is also set on the second upper blade lateral side;

a first extending end and a second extending end are set at two ends of the spring, wherein the second extending end has a corner; when the slider is assembled, the connecting shaft integrated with the pull-tab sets the pull-tab on the upper blade of the base by the U-shaped groove and the second connecting-shaft through hole; a first connecting-shaft through hole is formed with the two raised convex parts on the first upper blade lateral side close to each other towards the interior of the U-shaped groove, so as to fix the pull-tab to the upper blade of the slider base; the spring is installed by using the spring assembling hole and the conducting slot set at the second upper blade lateral side; when it is installed, the spring is inserted into the spring mounting hole through the spring assembling hole, and the second extending end having a corner gets into the spring mounting slot through the conducting slot; when the spring is installed and fixed, the spring is in a deformed state, and the first extending end of the spring clips into and is held by the annular slot.

2. The slider according to claim 1, wherein the first upper blade lateral side and the second upper blade lateral side extend towards the rear-end-face of the upper blade up to the rear-end of the upper blade.

3. The slider according to claim 1, wherein the first upper blade lateral side and the second upper blade lateral side extends towards the rear-end-face of the upper blade up to the middle of the rear-end plane of the square-shaped notch, and forms step-shaped structure with the rear-end plane.

4. The slider according to claim 1, wherein a lug boss is set at the first upper blade lateral side and set closer to rear-end of the upper blade, and a notch is set between the lug boss and the convex part closer to the lug boss.

5. The slider according to claim 1, wherein a first platform is extended with outwards at the first upper blade lateral side, and a second platform is extended with outwards at the second upper blade lateral side.

6. The slider according to claim 1, wherein said concave surface has a locking through hole, which is set closer to the first connecting-shaft through hole; a locking head is set at the bottom of the locking part and matching with the locking through hole.

7. The slider according to claim 1, wherein a slot platform is set at the lower-end of the annular slot, and the side surface of the slot platform withstands the bottom part of the first extending end of the spring; the slot platform could prevent the spring from elastic deformation, losing of elasticity or popping because of spring rotating during use.

8. The slider according to claim 1, wherein a lower blade sunk platform which sags inward towards the lower surface of the lower blade respectively at both sides of the upper surface of the lower blade closer to the connecting pins.

9. The slider according to claim 1, wherein an upper blade sunk platform which sags inward towards the upper surface of the upper blade respectively at both sides of the lower surface of the upper blade closer to the connecting pins.

10. The slider according to claim 1, wherein a protruding platform is set on the side surface of the pull-tab body closer to one side of the first connecting-shaft through hole at the point which the connecting shaft is connected with, said protruding platform is set at both ends of the connecting shaft and extending along the length direction of the pull-tab.

11. The slider according to claim 1, wherein both ends of the connecting shaft are set as truncated cone shape.

12. The slider according to claim 1, wherein the length of the connecting shaft is set as 1.8-2.3 times of the anterior-end width of the pull-tab body.

13. The slider according to claim 1, wherein the depth of the spring mounting hole is set as ½-⅔ of the length of the spring.

* * * * *